United States Patent [19]

Fisher et al.

[11] Patent Number: 4,930,979

[45] **Date of Patent: * Jun. 5, 1990**

[54] COMPRESSORS

[75] Inventors: Frank B. Fisher; Paul J. Langdon, both of Huddersfield, England

[73] Assignee: Cummins Engine Company, Inc., Columbus, Ind.

[ * ] Notice: The portion of the term of this patent subsequent to May 10, 2005 has been disclaimed.

[21] Appl. No.: 190,968

[22] Filed: May 9, 1988

Related U.S. Application Data

[63] Continuation of Ser. No. 945,713, Dec. 23, 1986, Pat. No. 4,743,161.

[51] Int. Cl.[5] ..... F04D 29/42

[52] U.S. Cl. ..... 415/58.4; 415/58.3; 415/206; 415/914

[58] Field of Search ..... 415/11, 58.3, 58.4, 415/116, 206, 914, 119, 144

[56] References Cited

U.S. PATENT DOCUMENTS

| | | | |
|---|---|---|---|
| 2,393,933 | 1/1946 | Poole | 415/214.1 |
| 2,832,292 | 4/1958 | Edwards | 415/53 R X |
| 3,217,655 | 11/1965 | Sercy | 415/116 |
| 3,379,366 | 4/1968 | Garnier | 415/61 |
| 3,462,071 | 8/1969 | Garve | 415/116 |
| 3,504,986 | 4/1970 | Jackson | 415/53 R |
| 3,887,295 | 6/1975 | Yu | 415/116 |
| 3,901,620 | 5/1975 | Moore et al. | 415/DIG. 1 X |
| 4,212,585 | 7/1980 | Swarden et al. | 415/53 R |
| 4,248,566 | 2/1981 | Chapman et al. | 415/DIG. 1 X |
| 4,375,937 | 3/1983 | Cooper | 415/53 R |
| 4,375,938 | 3/1983 | Dussourd | 415/53 R |
| 4,479,755 | 10/1984 | Skoe | 415/DIG. 1 X |
| 4,743,161 | 5/1988 | Fisher et al. | 415/53 R |

FOREIGN PATENT DOCUMENTS

| | | | |
|---|---|---|---|
| 840348 | 6/1952 | Fed. Rep. of Germany . | |
| 536430 | 10/1931 | Fed. Rep. of Germany . | |
| 1815229 | 8/1970 | Fed. Rep. of Germany . | |
| 2458709 | 6/1975 | Fed. Rep. of Germany . | |
| 46-42817 | 12/1971 | Japan . | |
| 273364 | 10/1970 | U.S.S.R. . | |
| 478957 | 10/1975 | U.S.S.R. . | |
| 589689 | 6/1947 | United Kingdom . | |
| 897575 | 5/1962 | United Kingdom . | |
| 1043168 | 9/1966 | United Kingdom | 415/DIG. 1 |
| 1153345 | 5/1969 | United Kingdom . | |

OTHER PUBLICATIONS

Allied Signal Drawing, HGS Compressor.
Kammer and Rautenberg, A Distinction Between Different Types of Stall Centrifugal Compressor Stage.
Kammer and Rautenberg, An Experimental Investigation of Rotating Stall Flow in a Centrifugal Compressor.
Berenyi and Raffa, Variable Area Turbocharger for High Output Diesel Engines.
Rodgers, Impeller Stalling as Influenced by Diffusion Limitions.
Harp and Oatway, Centrifugal Compressor Development for a Variable Area Turbocharger.
Harp and Yano, Development of a Broad Range Turbocharger using Compressor to Turbine Bleed.
Takata and Tsukuda, Study on the Mechanism of Stall Margin Improvement of Casing Treatment.
Jansen, Carter and Swarden, Improvements in Surge Margin for Centrifugal Compressors.
Chapman, Model 250/C30/C28B Compressor Development.
Crosby et al., The Design and Development of the C Series Diesel Engine.
Fisher, Application of Map Width Enhancement Devices to Turbocharger Compressor Stages.

*Primary Examiner*—Robert E. Garrett
*Assistant Examiner*—John T. Kwon
*Attorney, Agent, or Firm*—Gary M. Gron

[57] ABSTRACT

The disclosure illustrates a range improvement feature for a compressor wheel in which a chamber adjacent the inlet is separated from the outer periphery of the impeller wheel vanes by a wall through which communication is established between the chamber and the impeller wheel. Communication is provided by either an annular slot or a series of radial holes. The feature may be used on single stage or multistage compressors. The area of the communication is such that at high rpm, and/or high flow, flow is from the chamber inward and at lower flows the flow is from the impeller wheel outward. This bidirectional flow improves the range over which the compressor may operate without encountering surge.

43 Claims, 4 Drawing Sheets

COMPRESSORS

This application is a divisional/continuation of application Ser. No. 945,713, filed December 23, 1986 now U.S. Pat. No. 4,743,161.

The air is thus not bled to the exterior of the housing, and thus atmosphere, nor drawn in from atmosphere separately from the normal gas intake to the compressor (as in U.S. Pat. No. 4,248,566), but is bled back to the normal intake or is drawn from the normal intake.

Accordingly to the present invention there is provided a compressor comprising an impeller wheel including a plurality of vanes or blades each of which includes a leading edge, a trailing edge and an outer free edge. The wheel is mounted for rotation within a housing, the housing including an inner wall and an outer wall. At least part of the inner surface of the inner wall is in close proximity to, and of similar contour to, the outer free edges of the blades or vanes. The inner wall forms an inlet to the impeller wheel in a region adjacent the leading edges of the blades or vanes, the outer wall forming a gas intake surrounding the inner wall and extending in an axial direction. A chamber, preferably an annular chamber, is formed between said inner and outer walls in a region preferably at least partly surrounding said blades or vanes. Communication is provided through the inner wall between said chamber and the inner surface of said inner wall whereby gas may pass in both directions between the area swept by the vanes or blades and the chamber.

The invention will now be further described by way of example with reference to the accompanying drawings in which.

Figure 1:
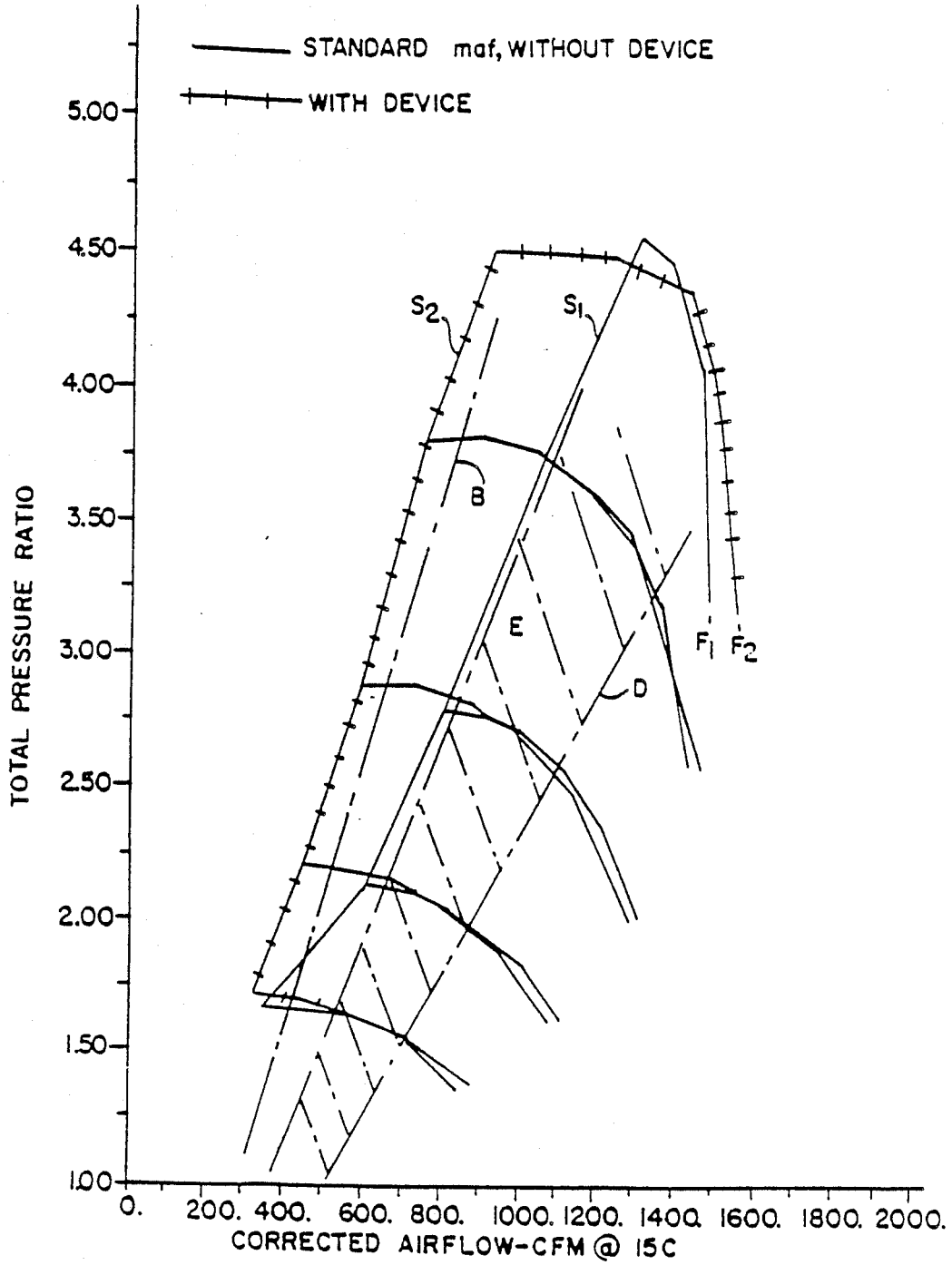
FIG. 1 is a graph of pressure against mass flow in a compressor.

Referring to FIG. 1 there is shown a graph plotting pressure against mass flow in a single stage centrifugal compressor. The area between the lines D and E which is shown by shading, indicates a typical engine r.p.m. range over which a compressor not incorporating the present invention will operate. There is however a requirement to increase the engine r.p.m. range to cover an area between the lines D and B on the graph and it is therefore necessary to alter the characteristics of the compressor in order to move the surge line from the line marked $S_1$ to the line marked $S_2$. This performance can be achieved by use of the present invention. Similar results can be achieved with an axial compressor.

Figure 2:
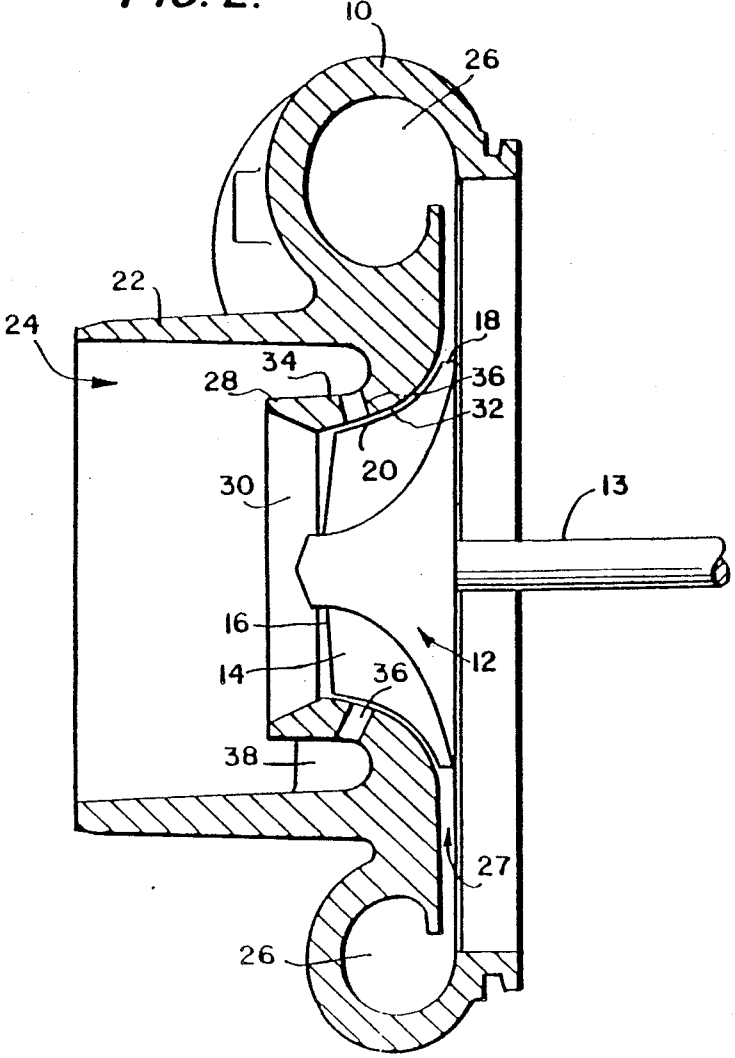
FIG. 2 is a cross-section through part of a compressor in accordance with one embodiment of the present invention.

Referring now to FIG. 2, there is shown a cross-section view of a single stage centrifugal compressor comprising a housing 10 having an impeller wheel 12 mounted on shaft 13 which is journalled for rotation.

The wheel 12 includes a plurality of blades or vanes 14, each including a leading edge 16, a trailing edge 18 and an outer free edge 20. The housing 10 includes an outer wall 22, defining an intake 24 for gas such as air, and a passageway or volute 26 for carrying compressed gas from an annular diffuser 27 adjacent the impeller wheel 12 to its destination e.g. the inlet manifold of an internal combustion engine. An inner wall 28 defines an inlet 30 to the impeller and an inner surface 32 of the inner wall 28 is in close proximity to and of extremely similar contour to, the outer free edges 20 of the blades or vanes 14. The inner wall 28 extends a short distance upstream from the blades 14 of the impeller wheel 12 to form an annular space or chamber 34 between the walls 22 and 28. The annular chamber 34 partly surrounds the impeller wheel 12. An annular slot 36 is formed in the wall 28 and a series of webs 38 serve to bridge the annular slot 36 at intervals round its circumference. The slot 36 is at a location along the meridional length of the inner surface of the inner wall just upstream of the point of minimum pressure. This location is preferably some 65 to 75% of the distance from the leading edges 16 of the blades or vanes 14 to the point of minimum pressure and is typically 22 to 34% of the impeller blade length. In the arrangement shown in FIG. 2 the slot is located some 73% of the distance from the leading edge 16 of the blades 14 to the point of minimum pressure and is 30% of the length of the impeller blades 14 from the leading edges 16 of the blades.

The total area of the slot is normally of the order of 13 to 23% of the inducer annular area. In the arrangement shown the total area of the slot is 15% of the inducer annular area (flow area of inlet 30 minus area of the hub of wheel 12).

In operation the impeller wheel 12 is rotated e.g. by a turbine wheel (not shown) attached to the common shaft 13 with the compressor wheel and this causes air to be drawn into the impeller wheel 12 through intake 24 and inlet 30. The air is compressed by the impeller wheel 12 and is then fed to its ultimate destination via diffuser 27 and passageway or volute 26. The pressure in the chamber 34 is normally lower than atmospheric pressure and during high flow and high r.p.m. operation the pressure in the area swept by the impeller wheel is less than in the chamber 34 and thus air flows inward through the slot 36 from the chamber 34 to the impeller wheel 12 thereby increasing the amount of air reaching the impeller wheel, and increasing its maximum flow capacity. As the flow through the impeller wheel 12 drops, or as r.p.m. of the impeller wheel drops, so the amount of air drawn into the wheel 12 through the slot 36 decreases until equilibrium is reached. Further drop in impeller wheel flow or r.p.m. results in the pressure in the area swept by the impeller wheel being greater than in the chamber 34 and thus air flows outward through the slot 36 from the impeller 12 to the chamber 34. The air bled out of the impeller wheel 12 is recirculated to the air intake and thereby back to the inlet 30. Increase in flow or r.p.m. of the impeller wheel causes the reverse to happen, i.e., a decrease in the amount of air bled from the impeller wheel followed by equilibrium followed by air being drawn into the impeller wheel 12 via the slot 36. This particular arrangement results in improved stability of the compressor at all speeds and a shift in the characteristics of the compressor. For example, the surge line is moved as shown in FIG. 1 from $S_1$ to $S_2$ and the maximum flow capacity is moved from line $F_1$ to $F_2$ as shown in FIG. 1. The compressor can thus be matched to engines with a wider speed range than can conventional compressors.

Figure 3:
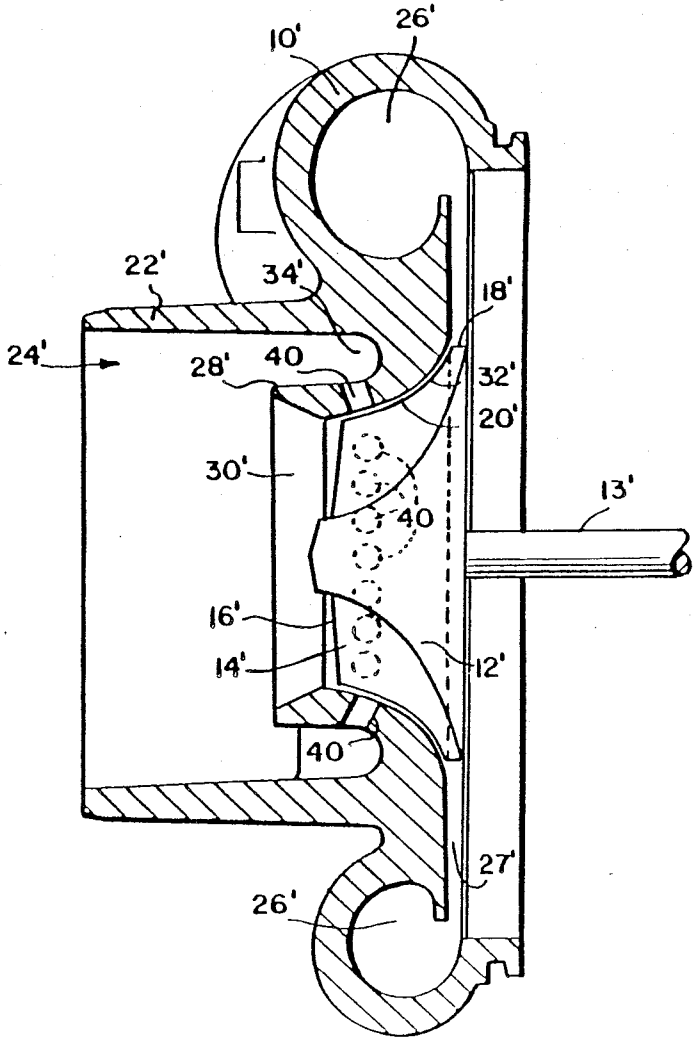
FIG. 3 is a cross-section through part of a compressor in accordance with another embodiment of the present invention.

Referring now to FIG. 3 there is shown an alternative embodiment in which the slot 36 is replaced by a series of holes 40 and in which like elements are designated by like numbers with a prime. In this case there is of course no need for the webs 38 of the arrangement of FIG. 2. The positioning of the holes 40 along the meridional length and the area of the holes at the inner surface 32' is similar to the positioning and area of the slot 36 in FIG. 2. The number of holes should be arranged so that it is not equal to, nor a multiple of, nor a factor of the number of blades on the compressor wheel. If the number of holes is a multiple of or a factor of the number of blades then vibratory excitation can be induced. In the arrangement shown in FIG. 3 the number of holes 40 is 29 and the number of blades is 16.

Figure 4:
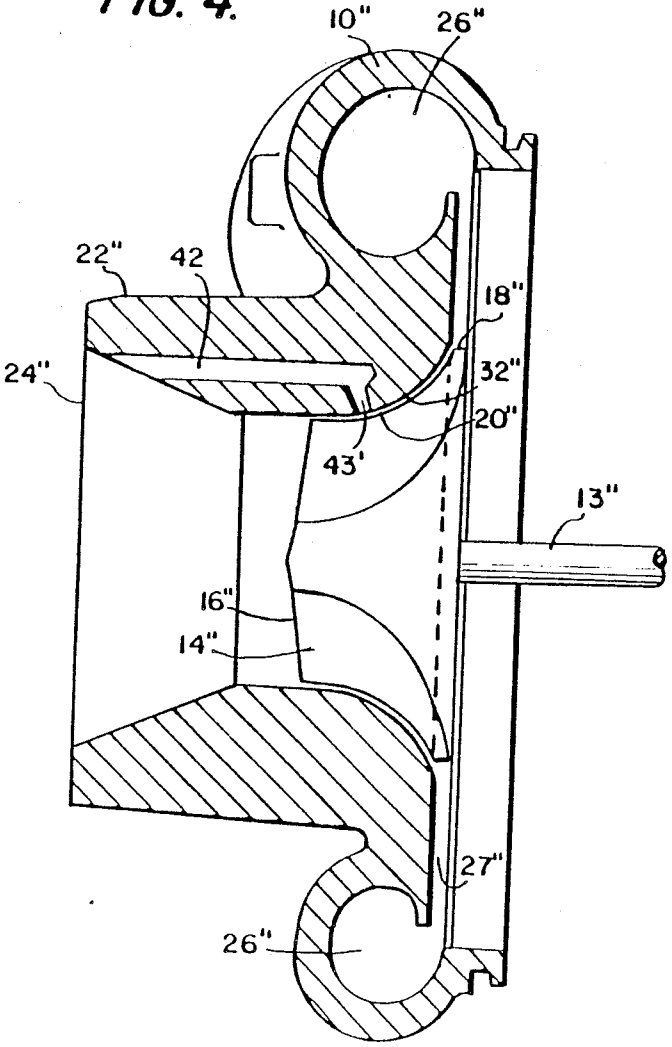
FIG. 4 is a cross-section through part of a compressor in accordance with a further embodiment of the present invention.

Referring now to FIG. 4 there is shown a further alternative embodiment of the invention in which the flow communication function of chamber 34 is provided by a series of blind bores 42 (only one of which is shown) formed in the wall 22'' of the housing 10''. As shown in FIG. 4 each bore 42 is connected to a hole 43 extending inward to surface 32''. Alternately the bores 42 may extend to an annular slot similar to slot 36 in FIG. 2.

Figure 5:
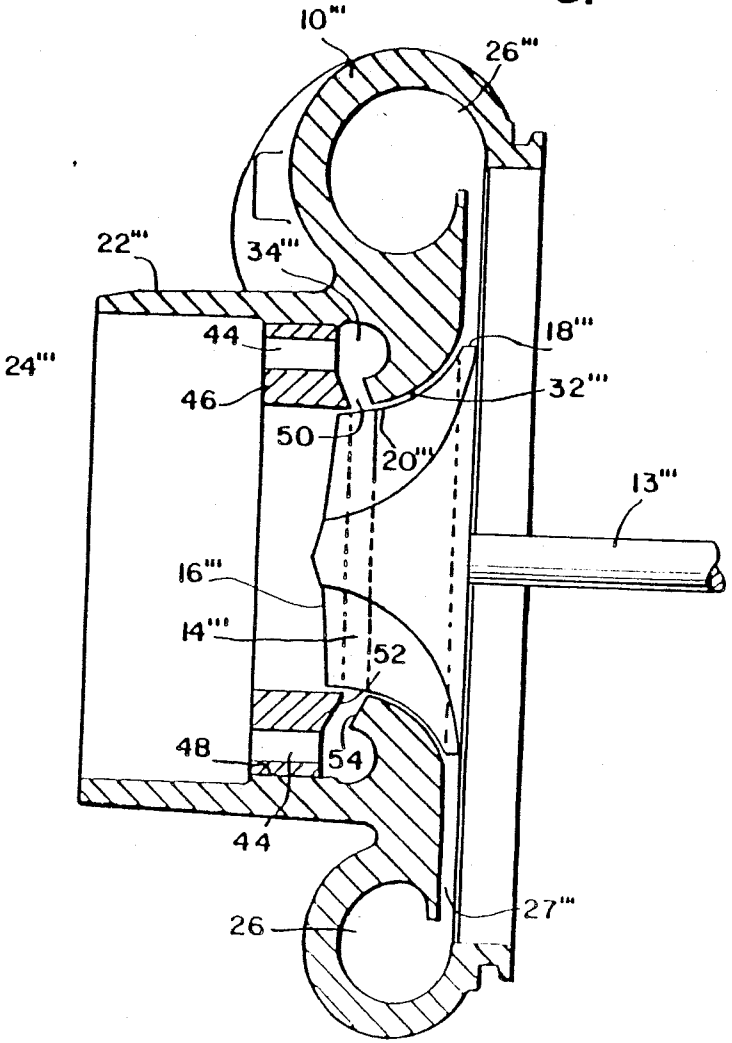
FIG. 5 is a cross-section through part of a compressor in accordance with yet a further embodiment of the present invention.

Referring now to FIG. 5 there is shown an arrangement in which the chamber 34''' is formed partly in the housing 10''' and partly by series of holes 44 formed in a ring 46 which may be aluminum or plastic and press fit or otherwise retained within a bore 48 formed in outer wall 22'''. The chamber 34''', as in other embodiments, communicates with the impeller wheel 12 via a series of holes or a slot 50 formed between upstream axial end face 52 of ring 46 and an annular end wall 54 of housing 10'''.

Figure 6:
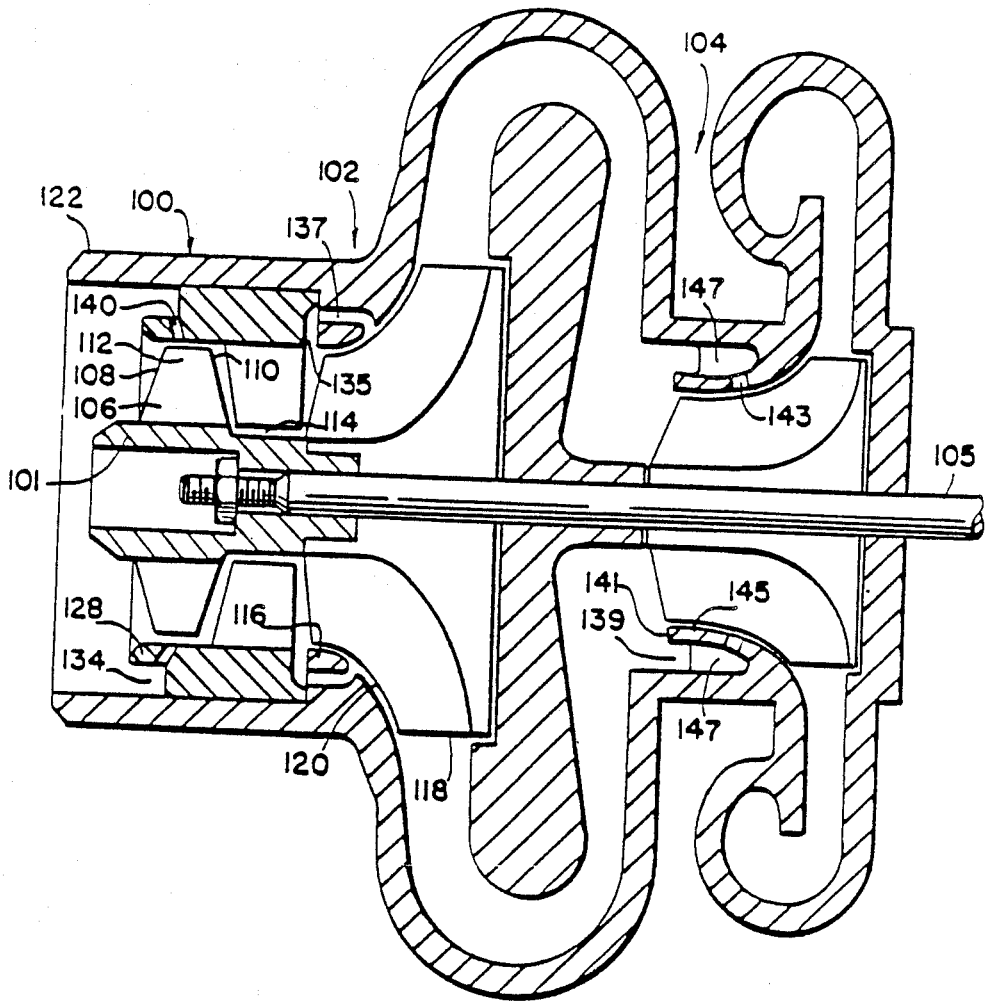
FIG. 6 is a cross-section through a multistage compressor in accordance with the present invention.

Referring now to FIG. 6, there is shown a multistage compressor, comprising an axial compressor 100, and two centrifugal compressors 102 and 104 arranged in series on shaft 105 suitably journalled for rotation. Axial compressor 100 includes an impeller wheel 101 having a series of vanes or blades 106 each of which includes a leading edge 108, a trailing edge 110 and an outer free edge 112. Air compressed by compressor 100 is fed via axial outlet 114 to the inlet 116 of centrifugal compressor 102. Axial compressor 100 includes inner and outer walls 128 and 122 respectively defining an annular space or chamber 134 as in the arrangement of FIGS. 2 and 3. In addition, a slot, or a series of holes 140 (as shown), is provided in wall 128 as in the device of FIG. 2. Operation is similar to that of the device of FIGS. 2 and 3 with air bleeding from the impeller wheel 101 to the chamber 134 near surge and with air being drawn from the chamber 134 to the impeller 101 at high flow and high r.p.m.

Compressor 102 has an annular chamber 135 adjacent inlet 116. A series of passageways 137 extend from the perifery of the impeller for compressor 102 to chamber 135.

Similarly compressor 104 has a chamber 139 adjacent its inlet 141. In this case an annular slot 143 extends through an annular wall 145 separating chamber 139 from the perifery of the compressor impeller. A series of webs 147 mount wall 145 with respect to the housing.

The compressor of the present invention is especially useful when forming part of a turbocharger for an internal combustion engine particularly where an air cleaner is provided upstream of the air intake to the compressor. This latter preference is because the air cleaner results in the air pressure in the intake being depressed below atmospheric to a greater extent than without an air cleaner and thus results in even better operation of the compressor of the invention due to the pressure differential between the two ends of the slot or holes at low flow (i.e. near surge) being greater.

The respective areas of the passages and their position relative to the impeller are as described in connection with FIG. 2 above.

Although several preferred embodiments of the present invention have been described, it should be apparent to those skilled in the art that it may be practiced in other forms without departing from its spirit and scope.

What is claimed as novel and desired to be secured by letters patent of the United States is:

1. A compressor operable between choked flow and surge line conditions for compressing gas, comprising:

a housing having an inner wall and an outer wall;

an impeller wheel mounted for rotation in a defined area within said housing and having a plurality of vanes each of which has a leading edge, a trailing edge and an outer free edge;

said outer wall extending in an axial direction toward said impeller wheel and having a first portion forming a gas intake and a second portion surrounding said inner wall;

said inner wall forming an inlet to said impeller wheel in a region adjacent said leading edges of said vanes and having an inner surface, at least part of said inner surface of said inner wall being in close proximity to said outer free edges of said vanes;

said inner wall and said second portion of said outer wall forming a chamber separated from and at least partially surrounding said vanes and in communication with said gas intake; and, a flowpath through said inner wall between said chamber and said defined area, said flowpath through said inner wall being located adjacent to a portion of said outer free edges of said vanes downstream not exceeding 34% of the total meridional length and having a total cross sectional flow area at the inner surface of said inner wall at least 13% of an inducer annular area defined by the area of said inlet minus the area occupied by said impeller wheel to permit gas movement in one direction or in the other direction through said flowpath in response to the pressure differential between said chamber and said defined area to broaden the range of operation between the choked flow and the surge line conditions for said compressor.

2. A compressor as in claim 1, in which the compressor is a centrifugal compressor and said flowpath through said inner wall is located adjacent to a portion of said outer free edges of said vanes upstream along the meridional length from the point of minimum pressure and said total cross sectional flow area at the inner surface of said inner wall is between 13 to 23% of an inducer annular area.

3. A compressor as in claim 2, in which said flowpath through said inner wall is adjacent a location from 65 to 75% of the distance from said leading edge of said vanes to the minimum pressure point.

4. A compressor as in claim 3, in which said flowpath between said chamber and said defined area is defined by an annular slot extending around and formed in said inner wall and a plurality of connecting webs bridging said slot.

5. A compressor as in claim 3, in which said flowpath between said chamber and said defined area is defined by a series of holes formed through said inner wall between said chamber and said defined area.

6. A compressor as in claim 5, in which the number of said hoes is not equal to, not a multiple of, and not a factor of, the number of said vanes of said impeller wheel.

7. A compressor as in claim 6, in which said holes number from 29 to 43.

8. A compressor as in claim 1, in which said total cross sectional flow area at the inner surface of said inner wall is between 13 to 23% of said inducer annular area.

9. A compressor as in claim 8, in which said flowpath through said inner wall being located adjacent to a portion of said outer free edges of said vanes downstream between 22 to 34% of the total meridional length.

10. A compressor as in claim 1, in which said flowpath through said inner wall being located adjacent to a portion of said outer free edge of said vanes downstream between 22 to 34% of the total meridional length.

11. A compressor for use in compressing gas in a turbocharger of an internal combustion engine and being operable between choked flow and surge line conditions, said compressor comprising:

a housing having an inner wall and an outer wall;

an impeller wheel mounted for rotation in a defined area within the housing and having a plurality of vanes each of which has a leading edge, a trailing edge and an outer free edge;

said outer wall extending in an axial direction toward said impeller wheel and having a first portion forming a gas intake and a second portion surrounding said inner wall;

said inner wall forming an inlet to said impeller wheel in a region adjacent said leading edges of said vanes and having an inner surface, at least part of said inner surface being in close proximity to said outer free edges of said vanes;

said inner wall and said second portion of said outer wall forming a chamber separated from and at least partly surrounding said vanes and in communication with said gas intake;

a bi-directional flowpath through said inner wall between said chamber and said defined area;

said flowpath being located adjacent to a portion of said outer free edges of said vanes downstream not exceeding 34% of the total meridional length and having a total cross sectional flow area at the inner surface of said inner wall at least 13% of an inducer annular area defined by the area of said inlet minus the area occupied by said impeller wheel;

said chamber having a higher pressure relative to said defined area when said impeller wheel is rotated above a first number of revolutions per minute whereby gas from said intake passes into said chamber and out through said flowpath into said defined area thereby increasing maximum flow capacity;

said chamber having a lower pressure relative to said defined area when said impeller wheel is rotated below a second number of revolutions per minute whereby gas from said defined area passes through said flowpath into said chamber for recirculation to said inlet; and said first number of revolutions per minute being greater than said second number of revolutions per minute.

12. A compressor as in claim 11, in which the compressor is a centrifugal compressor and said flowpath through said inner wall is located adjacent to a portion of said outer free edges of said vanes upstream along the meridional length from the point of minimum pressure and said total cross sectional flow area at the inner surface of said inner wall is between 13 to 23% of an inducer annular area.

13. A compressor as in claim 12, in which said flowpath is at a location from 65 to 75% of the distance from said leading edge of said vanes to the minimum pressure point.

14. A compressor as in claim 13, in which said flowpath between said chamber and said defined area is defined by an annular slot extending around and formed in said inner wall and a plurality of connecting webs bridging said slot.

15. A compressor as in claim 12, in which said flowpath between said chamber and said defined area is defined by a series of holes formed through said inner wall between said chamber and said defined area.

16. A compressor as in claim 15, in which the number of said holes is not equal to, not a multiple of, and not a factor of, the number of said vanes of said impeller wheel.

17. A compressor as in claim 16, in which said holes number from 29 to 43.

18. A compressor as in claim 11, further comprising at least a second compressor connected in series flow relationship to said first compressor, said second compressor comprising:

a housing having an inner wall and an outer wall;

an impeller wheel mounted for rotation in a defined area within said housing and having a plurality of vanes each of which has a leading edge, a trailing edge and an outer free edge;

said outer wall extending in an axial direction toward said impeller wheel and having a first portion forming a gas intake and a second portion surrounding said inner wall;

said inner wall forming an inlet to said impeller wheel in a region adjacent said leading edges of said vanes and having an inner surface, at least part of said inner surface of said inner wall being in close proximity to said outer free edges of said vanes;

said inner wall and said second portion of said outer wall forming a chamber separated from and at least partially surrounding said vanes and in communication with said gas intake;

a flowpath through said inner wall between said chamber and said defined area, said flowpath through said inner wall being located adjacent to a portion of said outer free edges of said vanes downstream not exceeding 34% of the total meridional length and having a total cross sectional flow area at the inner surface of said inner wall at least 13% of an inducer annular area defined by the reason of said inlet minus the area occupied by said impeller wheel to permit gas movement in one direction or in the other direction through said flowpath in response to the pressure differential between said chamber and said defined area.

19. A compressor as in claim 18, in which said total cross sectional flow area at the inner surface of said inner wall is between 13 to 23% of said inducer annular area.

20. A compressor as in claim 19, in which said flowpath through said inner wall being located adjacent to a portion of said outer free edges of said vanes downstream between 22 to 34% of the total meridional length.

21. A compressor as in claim 18, in which said flowpath through said inner wall being located adjacent to a portion of said outer free edge of said vanes downstream between 22 to 34% of the total meridional length.

22. A compressor as in claim 11, in which said total cross sectional flow area at the inner surface of said inner wall is between 13 to 23% of said inducer annular area.

23. A compressor as in claim 22, in which said flowpath through said inner wall being located adjacent to a portion of said outer free edges of said vanes downstream between 22 to 34% of the total meridional length.

24. A compressor as in claim 11, in which said flowpath through said inner wall being located adjacent to a portion of said outer free edge of said vanes downstream between 22 to 34% of the total meridional length.

25. A compressor operable between choked flow and surge line conditions for compressing gas, comprising:

a housing having an outer wall forming a gas intake;

an impeller wheel for rotation in a defined area within said housing and having a plurality of vanes each of which has a leading edge, a trailing edge and an outer free edge;

said outer wall having an annular end face positioned adjacent said outer free edges of said vanes and having an inner surface, at least part of the inner surface of said outer wall being in close proximity to said outer free edges of said vanes;

an annular ring forming a gas inlet proximate said leading edges of said vanes and spaced downstream from said gas intake;

a chamber formed in said housing and at least partially surrounding said vanes and in communication with said gas intake;

said annular end face of said outer wall and said annular ring defining a flowpath between said chamber and said defined area; and said flowpath permitting gas movement in one direction or in the other direction through said flowpath in response to the pressure differential between said chamber and said defined area to broaden the range of operation between the choked flow and surge line conditions for said compressor.

26. A compressor as in claim 25, in which the total cross sectional flow area of said flowpath is from 13 to 23% of the inducer annular area defined by the area of said inlet minus the area occupied by said impeller wheel.

27. A compressor as in claim 26, in which the compressor is a centrifugal compressor and said flowpath is located adjacent to a portion of said outer free edges of said vanes upstream along the meridional length from the point of minimum pressure.

28. A compressor as in claim 27, in which said flowpath is at a location from 65 to 75% of the distance from said leading edge of said vanes to the minimum pressure point.

29. A compressor as in claim 25, in which said flowpath is located adjacent to a portion of said outer free edges of said vanes downstream between 22 to 34% of the meridional length.

30. A compressor operable between choked flow and surge line conditions for compressing gas, comprising:

a housing having an outer wall forming a gas intake;

an impeller wheel mounted for rotation in a defined area within said housing and having a plurality of vanes each of which has a leading edge, a trailing edge and an outer free edge;

said outer wall having a sloping inner wall surface portion extending toward said impeller wheel, a linear inner wall surface portion in a region adjacent said leading edges of said vanes and forming a gas inlet, and a curved inner wall surface portion in a region adjacent said outer free edges of said vanes, at least part of said curved inner wall surface portion being in close proximity to said outer free edges of said vanes;

a plurality of annularly spaced, axially extending bores formed in said outer wall, each bore having one end terminating at said inner wall surface portion and a second end forming a chamber in said outer wall at least partially surrounding said vanes;

a flowpath in said outer wall between said chamber and said defined area; and said flowpath permitting gas movement in one direction or in the other direction through said flowpath in response to the pressure differential between said chamber and said defined area to broaden the range of operation between the choked flow and surge line conditions of said compressor.

31. A compressor as in claim 30, in which the total cross sectional flow area of said flowpath is from 13 to 23% of the inducer annular area defined by the area of said inlet minus the area occupied by said impeller wheel.

32. A compressor as in claim 31, in which the compressor is a centrifugal compressor and said flowpath is located adjacent to a portion of said outer free edge of said vanes upstream along the meridional length from the point of minimum pressure.

33. A compressor as in claim 32, in which said flowpath is at a location from 65 to 75% of the distance from said leading edge of said vanes to the minimum pressure point.

34. A compressor as in claim 31, in which said flowpath is located adjacent to a portion of said outer free edges of said vanes downstream between 22 to 34% of the meridional length.

35. A multistage compressor operable between choked flow and surge line conditions for compressing gas, comprising:

at least two compressors connected in series relationship;

one of said compressors comprising a housing having an inner wall and an outer wall;

an impeller wheel mounted for rotation in a defined area within said housing and having a plurality of vanes each of which has a leading edge, a trailing edge and an outer free edge;

said outer wall extending in an axial direction toward said impeller wheel and having a first portion forming a gas intake and a second portion surrounding said inner wall;

said inner wall forming an inlet to said impeller wheel in a region adjacent said leading edges of said vanes and having an inner surface, at least part of said inner surface of said inner wall being in close proximity to said outer free edges of said vanes;

said inner wall and said second portion of said outer wall forming a chamber separated from and at least partially surrounding said vanes and in communication with said gas intake;

a flowpath through said inner wall between said chamber and said defined area said flowpath through said inner wall being located adjacent to a portion of said outer free edges of said vanes downstream not exceeding 34% of the total meridional length and having a total cross sectional flow area at the inner surface of said inner wall at least 13% of an inducer annular area defined by the area of said inlet minus the area occupied by said impeller wheel to permit gas movement in one direction or in the other direction through said flowpath in response to the pressure differential between said chamber and said defined area to broaden the range of operation between the choked flow and the surge line conditions for said compressor.

36. A multistage compressor as in claim 35, wherein said other compressor comprises:

a housing having an inner wall and an outer wall;

an impeller wheel mounted for rotation in a defined area within said housing and having a plurality of vanes each of which has a leading edge, a trailing edge and an outer free edge;

said outer wall extending in an axial direction toward said impeller wheel and having a first portion forming a gas intake and a second portion surrounding said inner wall;

said inner wall forming an inlet to said impeller wheel in a region adjacent said leading edges of said vanes and having an inner surface, at least part of said inner surface of said inner wall being in close proximity to said outer free edges of said vanes;

said inner wall and said second portion of said outer wall forming a chamber separated from and at least partially surrounding said vanes and in communication with said gas intake;

a flowpath through said inner wall between said chamber and said defined area to permit gas movement in one direction or in the other direction through said flowpath in response to the pressure differential between said chamber and said defined area.

37. A multistage compressor operable between choked flow and surge line conditions for compressing gas, comprising:

at least two compressors connected in series flow relationship;

one of said compressors comprising a housing having an outer wall forming a gas intake;

an impeller wheel for rotation in a defined area within said housing and having a plurality of vanes each of which has a leading edge, a trailing edge and an outer free edge;

said outer wall having an annular end face positioned adjacent said outer free edges of said vanes and having an inner surface, at least part of the inner surface of said outer wall being in close proximity to said outer free edges of said vanes;

an annular ring forming a gas inlet proximate said leading edges of said vanes and spaced downstream from said gas intake;

a chamber formed in said housing and at least partially surrounding said vanes and in communication with said gas intake;

said annular end face of said outer wall and said annular ring defining a flowpath between said chamber and said defined area; and said flowpath permitting gas movement in one direction or in the other direction through said flowpath in response to the pressure differential between said chamber and said defined area to broaden the range of operation between the choked flow and the surge line conditions for said compressor.

38. A multistage compressor operable between choked flow and surge line conditions for compressing gas, comprising:

at least two compressors connected in series flow relationship;

one of said compressors comprising a housing having an outer wall forming a gas intake;

an impeller wheel mounted for rotation in a defined area within said housing and having a plurality of vanes each of which has a leading edge, a trailing edge and an outer free edge;

said outer wall having a sloping inner wall surface portion extending toward said impeller wheel, a linear inner wall surface portion in a region adjacent said leading edges of said vanes and forming a gas inlet, and a curved inner wall surface portion in a region adjacent said outer free edges of said vanes, at least part of said curved inner wall surface portion being in close proximity to and surrounding said outer free edges of said vanes;

a plurality of annularly spaced, axially extending bores formed in said outer wall, each bore having one end terminating at said inner wall surface portion and a second end forming a chamber in said outer wall at least partially surrounding said vanes;

a flowpath in said outer wall between said chamber and said defined area; and said flowpath permitting gas movement in one direction or in the other direction through said flowpath in response to the pressure differential between said chamber and said defined area to broaden the range of operation between the choked flow and the surge line conditions for said compressor.

39. A compressor for use in compressing gas in a turbocharger of an internal combustion engine and being operable between choked flow and surge line conditions for compressing gas, comprising:

a housing having an inner wall and an outer wall;

an impeller wheel mounted for rotation in a defined area within said housing and having a plurality of vanes each of which has a leading edge, a trailing edge and an outer free edge;

said outer wall extending in an axial direction toward said impeller wheel and having a first portion forming a gas intake and a second portion surrounding said inner wall;

said inner wall forming an inlet to said impeller wheel in a region adjacent said leading edges of said vanes and having an inner surface, at least part of said inner surface of said inner wall being in close proximity to said outer free edges of said vanes;

said inner wall and said second portion of said outer wall forming a chamber separated from and at least partially surrounding said vanes and in communication with said gas intake;

a flowpath through said inner wall between said chamber and said defined area defined by an annular slot extending around and formed in said inner wall and a plurality of connecting webs bridging said slot; said flowpath being located adjacent to a portion of said outer free edges of said vanes downstream not exceeding 34% of the total meridional length and having a total cross sectional flow area at the inner surface of said inner wall at least 13% of an inducer annular area defined by the area of said inlet minus the area occupied by said impeller wheel; and, said flowpath permitting gas movement in one direction or in the other direction through said flowpath in response to the pressure differential between said chamber and said defined area to broaden the range of operation between the choked flow and the surge line conditions for said compressor.

40. A compressor as in claim 39, in which said total cross sectional flow area at the inner surface of said inner wall is between 13 to 23% of said inducer annular area.

41. A compressor as in claim 40, in which said flowpath through said inner wall being located adjacent to a portion of said outer free edges of said vanes downstream between 22 to 34% of the total meridional length.

42. A compressor as in claim 39, in which said flowpath through said inner wall being located adjacent to a portion of said outer free edge of said vanes downstream between 22 to 34% of the total meridional length.

43. A method for broadening the range of choked flow and surge line operating conditions of the compressor for compressing gas and having a housing with an outer wall and an inner wall, an impeller wheel mounted for rotation in an area defined by the inner wall, the outer wall forming a gas intake cavity, the inner wall forming a gas inlet to the impeller wheel and being in communication with the intake cavity, a chamber formed between the inner and outer walls and communicating with the intake cavity, and a bidirectional flowpath through the inner wall between the chamber and the defined area adjacent to a portion of said outer free edges of said vanes downstream not exceeding 34% of the total meridional length and having a total cross sectional flow area at the inner surface of said inner wall at least 13% of an inducer annular area defined by the area of said inlet minus the area occupied by said impeller wheel, the method comprising the steps of:

drawing gas into the gas intake cavity;

drawing gas from the gas intake cavity through the gas inlet into the defined area;

rotating the impeller wheel above a first number of revolutions per minute creating a low pressure condition in the defined area relative to the pressure in the chamber to effect gas flow from the intake cavity into the chamber and through the flowpath into the defined area for increasing maximum flow capacity; and, rotating the impeller wheel below a lower second number of revolutions per minute creating a high pressure condition in the defined area relative to the pressure in the chamber to effect gas flow from the defined area through the flowpath into the chamber for recirculation to the gas inlet.

* * * * *

UNITED STATES PATENT AND TRADEMARK OFFICE

CERTIFICATE OF CORRECTION

PATENT NO. : 4,930,979

DATED : June 5, 1990

INVENTOR(S) : Frank B. Fisher and Paul J. Langdon

It is certified that error appears in the above-identified patent and that said Letters Patent is hereby corrected as shown below:

On the cover page, in item [73], delete "Cummins Engine Company, Inc., Columbus, Ind." and add the correct assignee --Holset Engineering Company, Limited, Huddersfield, England --.

Signed and Sealed this

Thirty-first Day of December, 1991

*Attest:*

HARRY F. MANBECK, JR.

*Attesting Officer*

*Commissioner of Patents and Trademarks*